United States Patent [19]

Horton et al.

[11] 4,220,190

[45] Sep. 2, 1980

[54] METHOD OF MAKING TOOLING

[75] Inventors: Robert A. Horton, Chesterland; John H. Simmons, Lyndhurst; Timothy R. Bauer, Euclid, all of Ohio

[73] Assignee: Precision Metalsmiths, Inc., Cleveland, Ohio

[21] Appl. No.: 957,103

[22] Filed: Nov. 2, 1978

[51] Int. Cl.[3] ..... B22C 7/02; B22C 9/04

[52] U.S. Cl. ..... 164/35; 164/45; 249/116

[58] Field of Search ..... 164/35, 34, 23, 45, 164/9, 246, 6, 15; 249/116

[56] References Cited

U.S. PATENT DOCUMENTS

| | | | |
|---|---|---|---|
| 1,969,728 | 8/1934 | Cushman, Jr. | 164/6 |
| 2,515,017 | 7/1950 | Nicholson | 164/45 UX |
| 3,228,650 | 1/1966 | Gilliland et al. | 249/116 |

*Primary Examiner*—Robert D. Baldwin
*Assistant Examiner*—J. Reed Batten, Jr.
*Attorney, Agent, or Firm*—Watts, Hoffmann, Fisher & Heinke Co.

[57] ABSTRACT

A method of producing cast metal tooling, especially injection molds or dies, characterized by the steps of making a thin walled, investment cast shell which defines the functional cavity surface of the tooling, and casting a suitable backing metal against the shell to form a composite die or mold structure.

3 Claims, 5 Drawing Figures

METHOD OF MAKING TOOLING

BACKGROUND OF THE INVENTION

1. Field of the Invention

The invention relates to the making of investment cast metal tooling, particularly dies suitable for use in wax and plastic injection molding machines.

2. Description of the Prior Art

Molds have been made by electroplating a positive model of the part to be produced in order to form a relatively thin metal shell. The shell was subsequently provided with a relatively thick backing to produce a composite mold. A typical prior art process of this type is disclosed in U.S. Pat. No. 2,007,025.

Mold making operations involving electroplating or electroforming have several disadvantages. One such disadvantage is that electroplating limits the choice of metals that can be used to form the metal cavity shell. Other disadvantages of electroplating include the attendant pollution problems connected with the disposal of waste plating solutions and the highly specialized skills and technology required to carry out the process successfully.

Metal tooling also has been made by metal casting processes. It has been difficult, if not impossible, to produce cast tooling having the required dimensional tolerances for many applications. It has been necessary in such applications to finish machine the castings. The cost of the castings added to the cost of machining necessary to achieve the desired tolerances can exceed the cost of machining the tooling directly.

SUMMARY OF THE INVENTION

The invention provides a new inexpensive method of making cast metal tooling which can be used for a wide variety of purposes, including the molding of wax and plastic patterns such as are used in the investment casting art. The new method achieves greater as-cast dimensional accuracy than conventional cast tooling processes and provides for an economical way of producing a composite die or mold from a wide range of different metals selected to achieve desired properties and performance.

In carrying out the invention, the key step involves the production of an investment cast cavity shell which forms the working or functional surface of the die or mold. The cavity shell is subsequently provided with a suitable metal backing to form the composite metal die or mold structure. The investment casting process used to make the cavity shell permits a wide range of choice in the alloys that are employed. For example, the investment cast shell can be made from a hard, wear-resistant alloy and provided with a light-weight cast backing block of aluminum or other metal having high thermal conductivity.

The thin walled, investment cast metal shell can be made to close tolerances and is not subject to the dimensional variations common to conventional, as-cast metal tooling. As a consequence, one important feature of the invention is that little or no finish machining is necessary to achieve required dimensional accuracy. Because of the accuracy of manufacture and the reduction in cost, the new tooling can be used in many applications where conventionally produced cast tooling has not been considered practical or economical.

The method of the invention more particularly comprises the steps of making a positive model which is the reverse of the die cavity making a disposable pattern of uniform thickness which is the duplicate of the die cavity by coating the model with a thin layer of investment casting pattern material, coating or investing the pattern with refractory material to make a one-piece investment mold, removing the pattern, as by heating, to form a mold cavity, and casting the mold to form a thin walled cavity shell of substantially uniform thickness. Preferably, a suitable backing metal, such as aluminum or the like, is cast around the back of the shell to form a composite die structure.

In addition to providing an economical and practical way of making accurately dimensioned, cast metal tooling the method of the invention has the advantage of being completely compatible with the operations, equipment and materials already employed in investment foundries. Investment foundries can use the method to make wax and plastic injection molding dies with little or no additional cost. Another advantage is that the method can be carried out without the need of skilled machinists or specialized electroplating technology.

Still other advantages and fuller understanding of the invention will be had by reference to the following detailed description and the accompanying drawings.

DESCRIPTION OF THE PREFERRED EMBODIMENT

Injection molding dies suitable for making disposable patterns for the lost pattern process of investment casting normally have cavities that form the functional or working surfaces. These cavities are difficult to machine, especially when made of a hard metal, and as a result the manufacture of such dies has been an expensive, time-consuming procedure in the investment casting art. The invention is particularly applicable to and is hereinafter described in connection with the manufacture of plastic and wax injection molding dies, but will be understood to be useful for making many diffrent types of tooling for a wide variety of applications.

According to the preferred embodiment of the present invention, a model of the part to be formed in the die cavity is made from readily machinable material. This model is the counterpart or reverse of the required injection molding die cavity. Because the model is a positive, it can be accurately formed. A thin heat disposable pattern, preferably of uniform thickness, is then made by coating the model with a layer of heat disposable material, such as wax or a wax and synthetic resin composition. The pattern is stripped from the model and used to make an investment mold, i.e., either a ceramic shell mold or a solid investment mold.

After melting or otherwise disposing of the pattern, the mold is cast with any selected alloy to form a thin walled cavity shell. The shell is subsequently provided with a cast backing formed of a metal selected to provide improved die performance. The cast backing can be cast with the holes, slots or grooves needed to accommodate any desired die features such as cams, slides, cooling, etc.

Figure 1:
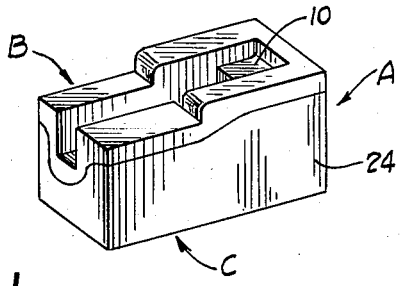
FIG. 1 is a perspective view of a die insert produced by the method of this invention.
Figure 2:
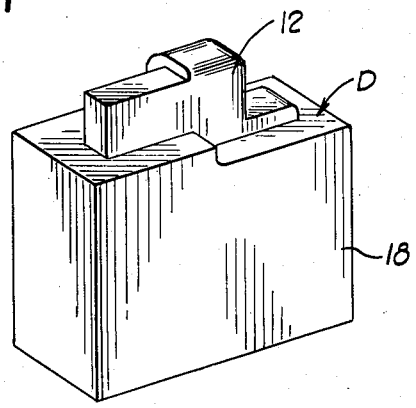
FIG. 2 is a perspective view of a model which is the counterpart of a part of the die insert to be produced.
Figure 3:
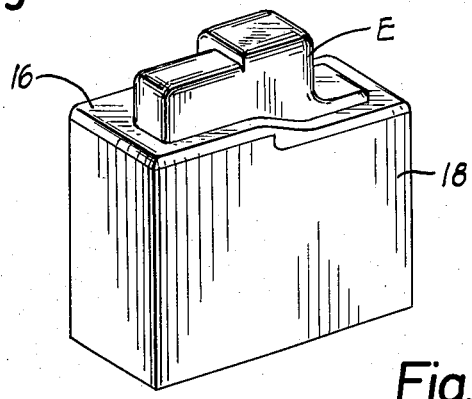
FIG. 3 is a perspective view of the model shown in FIG. 2 the top of which is coated with a heat disposable material.
Figure 4:
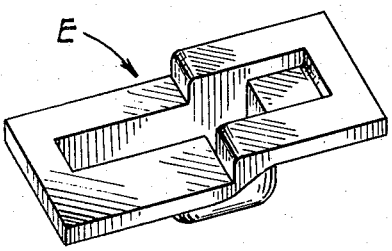
FIG. 4 is a perspective view of a heat disposable pattern produced by removing the coating shown in FIG. 3 from the model.

An exemplary composite die insert made pursuant to the present invention is depicted in FIG. 1 of the drawings and designated generally by the reference character A. The functional surface of the die A is defined by a relatively thin shell B of relatively hard metal having a cavity 10 in its face. The cavity shell B is provided with a backing C of any suitable metal. The cavity 10 is the counterpart or reverse of the investment casting pattern or a part thereof to be produced by the die A.

According to the present invention, a model D of readily machinable material, for example, aluminum is made having a part 12 which is the reverse of the cavity 10 and is a duplicate of the investment casting pattern intended to be produced in the cavity. The portion 12 of the model D can be accurately formed because the material of the model is readily machinable and the portion is a positive as distinguished from a negative cavity.

A heat disposable pattern E is made from the model D by coating the top of the model with a layer 16 of uniform thickness of suitable wax or investment casting pattern blend, such as that disclosed in U. S. Pat. No. 3,263,286. Another preferred pattern blend that is especially suitable for difficult to duplicate detail such as recess, serrations, threads, lettering, etc. consists of the following ingredients in amounts by weight:

60% paraffin wax (m.p. 134° F.)
37% stearic acid
3% ethylene vinyl acetate copolymer (79:21 vinyl to acetate comonomer ratio; ASTM ring and ball softening point 276° F.)

The coating operation can be carried out by pouring the molten pattern material over the model, by dipping the model into the molten pattern material, and/or by spraying or painting the pattern material onto the model, etc. Entrapped air bubbles should be avoided. The solidified pattern E is removed from the model D and trimmed, if necessary. If the model D is made of aluminum, its high conductivity facilitates solidification of the pattern material and its surface is such that the pattern can be readily removed from the model.

In making the pattern, it is preferable to apply a relatively thin layer of material to the model. If the material of the model is of high thermal conductivity, there is little if any shrinkage of the pattern. In the event the model is relatively small and/or thin it is preferably placed on a metal block, such as the block 18 which is also preferably made of material having high thermal conductivity, such as aluminum. The block 18 serves as a convenient handling means and as a heat sink thus enhancing the accurate reproduction of the model in the pattern. The pattern is preferably allowed to remain on the model until cold thus avoiding shrinkage of the pattern which, due to its uniform thickness, cools uniformly. In some cases, depending on the particular model configuration as well as the materials used for the model and the pattern, it may be difficult to remove the pattern after it has cooled to the vicinity of room temperature. In such cases, the pattern can usually be removed easily while it is still warm. A useful technique at this point is to relubricate the model, slide the pattern back onto it, and allow the model and pattern to cool to room temperature. Then it will be found that the pattern can be easily removed from the model and will have cavity dimensions which are substantially the same as the model dimensions.

Generally the disposable pattern will have a thickness between about 3/32" and 3/16", preferably in the range of about ⅛" to 5/32". It is desirable that this thickness be quite uniform, and this is usually best achieved by applying a number of very thin coatings to the model to achieve the desired final thickness.

Figure 5:
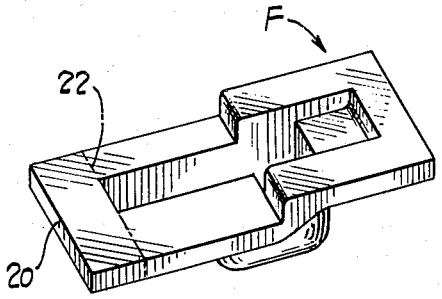
FIG. 5 is a perspective view of a hard material shell or die face plate made by investment casting using the pattern of FIG. 4.

One or more patterns are assembled to form an investment casting setup, such as disclosed, for example, in the U.S. Pat. No. 4,040,466. The set-up comprising one or more of the pattern E is then coated or invested with refractory material to form an investment mold from which the patterns are subsequently removed, as by heating according to known pattern removal techniques. The mold is cast with any of a wide range of alloys, for example, a relatively hard material to form an investment casting F which constitutes the cavity shell B of the die A after the end 20 has been removed at the line 22 in FIG. 5. A number of different metals can be used for the cavity shell B including ductile iron, beryllium cooper, and steel.

Because of its thinness, the cavity shell B preferably is provided with a backing 24 to produce the composite die A which is insertable into a standard die block of an injection molding machine. The base or backing 24 for the cavity shell B is preferably made by inverting the shell and casting over and around it a metal such as aluminum which is relatively inexpensive, easy to cast and machine, light-in-weight, and has good thermal conductivity. The result is a composite die having a thin, hard cavity surface formed by a thin shell B bonded to a light weight base 24.

It will be seen from the foregoing that the invention achieves the objectives of providing low cost, accurately dimensioned, cast metal tooling. The thin walled cavity shell B is not subject to the usual dimensional variations which occur during cooling and can be made to close tolerances so that finish machining of the cavity is not required for most applications. As a result, the composite die A can be used in many applications where conventional cast metal tooling is not practical or economical.

Many variations and modifications of the invention will be apparent to those skilled in the art in light of the foregoing detailed disclosure. Therefore, it is to be understood that, within the scope of the appended claims, the invention can be practiced otherwise than as specifically shown and described.

We claim:

1. A method of making cast metal tooling having a cavity comprising the steps of:

(a) making a positive model which is the counterpart of the cavity;
(b) making a uniform thickness disposable pattern by coating the model with a thin layer of investment casting pattern material;
(c) removing the pattern from the positive model;
(d) coating or investing the pattern with refractory material to form a one-piece investment mold;
(e) removing the pattern from the investment mold to form a mold cavity;
(f) filling the mold cavity with a selected alloy to form a thin walled cavity shell;

(g) removing the shell from the mold cavity; and,
(h) providing the shell with a backing.

2. A method of making a composite metal die having a cavity comprising the steps of:

(a) making a model having a face portion which is at least in part a positive counterpart of the cavity of the die to be produced;
(b) making a disposable pattern in the form of a contoured sheet by coating said face portion of the model with a layer of heat disposable material;
(c) removing the pattern from the model;
(d) investing the pattern with refractory material to form an investment mold;
(e) melting the pattern out of the investment mold to form a mold cavity;
(f) filling the mold cavity with a metal to form a thin walled investment casting shell;
(g) removing the shell from the mold cavity; and
(h) providing the investment casting shell with a metal backing to produce a composite die wherein the investment casting shell forms the working surface of the die with the cavity therein.

3. A method of making a composite metal die having a cavity comprising the steps of:

(a) making a metal model having a face portion which is at least in part the positive counterpart of the cavity of the die to be produced;
(b) making a disposable pattern in the form of a contoured sheet of uniform thickness by coating said face portion of the model with a uniform thickness layer of heat disposable material;
(c) removing the pattern from the model;
(d) investing the pattern with refractory material to form an investment mold;
(e) melting the pattern out of the investment mold to form a mold cavity;
(f) filling the mold cavity with relatively hard metal to form a relatively hard investment casting shell of uniform thickness;
(g) removing the investment casting shell from the mold cavity; and
(h) providing the investment casting shell with a metal backing having a lower melting point and of a softer metal than the metal of the investment casting shell to produce a composite die wherein the investment casting shell forms the cavity of the die.

* * * * *